US006056834A

United States Patent [19]

Kubota et al.

[11] Patent Number: 6,056,834

[45] Date of Patent: May 2, 2000

[54] MAGNESIUM ALLOY AND METHOD FOR PRODUCTION THEREOF

[75] Inventors: Kohei Kubota; Takashi Ogami; Tsutomu Sato; Koichi Sato; Mitsuharu Hoshiya, all of Saitama; Yoichi Nosaka, Yamanashi, all of Japan

[73] Assignee: Mitsui Mining & Smelting Company, Ltd., Japan

[21] Appl. No.: 09/101,346

[22] PCT Filed: Nov. 15, 1997

[86] PCT No.: PCT/JP97/04284

§ 371 Date: Jun. 30, 1998

§ 102(e) Date: Jun. 30, 1998

[30] Foreign Application Priority Data

| | | | |
|---|---|---|---|
| Nov. 25, 1996 | [JP] | Japan | 8/313204 |
| Jan. 13, 1997 | [JP] | Japan | 9/003457 |
| Jan. 13, 1997 | [JP] | Japan | 9/003548 |

[51] Int. Cl.[7] ..... C22F 1/06

[52] U.S. Cl. ..... 148/406; 420/407

[58] Field of Search ..... 148/406; 420/407

[56] References Cited

U.S. PATENT DOCUMENTS

| | | | |
|---|---|---|---|
| 2,429,221 | 10/1947 | Davis | 75/67 |
| 3,166,415 | 1/1965 | Conant | 75/202 |
| 4,168,161 | 9/1979 | Unsworth et al. | 75/168 J |
| 4,239,535 | 12/1980 | King et al. | 75/168 D |
| 5,501,748 | 3/1996 | Gjestland et al. | 148/538 |
| 5,693,158 | 12/1997 | Yamamoto et al. | 148/557 |

*Primary Examiner*—Daniel J. Jenkins

*Attorney, Agent, or Firm*—Bierman, Muserlian and Lucas

[57] ABSTRACT

A sample is taken out of a molten magnesium alloy, the cooling curve of the sample during solidification is measured, the content of the aluminum component in the sample is determined by the use of the crystallization temperature of a phase appearing in the cooling curve, together with cooling curves, and if the results of bath analysis show the components to deviate from the standard values and target values, an aluminum-manganese master alloy, aluminum or magnesium is added to the molten magnesium alloy to adjust the components to an appropriate amount of aluminum or an appropriate iron/manganese ratio, whereby a magnesium alloy is produced.

10 Claims, 3 Drawing Sheets

MAGNESIUM ALLOY AND METHOD FOR PRODUCTION THEREOF

TECHNICAL FIELD

This invention relates to a magnesium alloy and a method for its production. The invention also relates to a bath analysis method for a magnesium alloy which estimates the content of the aluminum component by utilizing the shape of the cooling curve of a molten magnesium alloy during its solidification; a component adjusting system for the magnesium alloy; and a technique for producing a magnesium alloy by the use of the bath analysis method and the component adjusting system.

BACKGROUND ART

A magnesium alloy is used for automobile parts and household appliances as an alloy for die casting or a castable alloy.

Alloys put to these uses are magnesium-aluminum alloys such as an AZ91 alloy (Mg, 9.0%-Al, 0.7%-Zn, 0.2%-Mn) and an AM60 alloy (Mg, 6.0%-Al, 0.2% Mn).

As a quality control method for such magnesium alloys, there has been a demand for the bath analysis method that can be performed easily, rapidly and safely at the site of casting.

For example, the bath analysis technique which utilizes the shape of a cooling curve during solidification has been established and has found widespread use for cast iron, aluminum alloys and zinc alloy castings.

However, such an established technology has not been proposed for magnesium alloys.

Furthermore, magnesium alloys pose problems such that molten magnesium is easily flammable, and its accurate cooling curve is difficult to obtain.

A magnesium alloy is utilized as a die castable alloy for precision parts. In this case, slight changes in the composition of the alloy are known to cause great changes in the yield.

A magnesium alloy may be used after remelting. During this remelting, changes in the components of the alloy occur.

As a result, a casting failure happens, or a trouble such as the lack of strength of the resulting casting occurs.

To solve these various problems, the establishment of a bath component analysis technique for a magnesium alloy has been desired.

In recent years, parts or cases for household appliances have been required to be smaller in wall thickness and more precise, and higher fluidity has been demanded for AZ91 alloy. AM60 alloy is used as a part required to have high impact strength among automobile parts. However, these alloys have a low aluminum content, and increase in melting point. Thus, unless the temperature of the molten metal is raised, appropriate fluidity is not obtained. However, the raise in the molten metal temperature causes the problem of the oxidation of the molten metal or the elution of the injection area.

To solve such problems, it is effective to ① set the aluminum component at a high content to lower the melting point, or ② improve fluidity, within the range of the components of AZ91 alloy or AM60 alloy. Delicate improvements and adjustments of the alloy composition that are associated with these measures cannot be satisfied by the alloy manufacturer requiring a mass production system as a prerequisite. Special manufacturing in a small quantity causes the problem of an increased cost.

A delicate change in the alloy composition on the part of the casting manufacturer involves the problems of requiring chemical analysis, taking time and entailing costs.

The objects of the present invention are to provide a bath analysis technique for a magnesium alloy (AZ91 alloy) which estimates the proportion of the aluminum component in the magnesium alloy by utilizing the shape of the cooling curve of the magnesium alloy during solidification; a component adjusting technique for the magnesium alloy; and a technique for correcting the aluminum component in the magnesium alloy with the aid of these techniques to produce the desired magnesium alloy.

Another object of the present invention is to provide a high fluidity magnesium alloy improved so as to have a higher aluminum component content than in conventional alloys, and a technique for producing such a magnesium alloy.

DISCLOSURE OF THE INVENTION

To attain the above-described objects, we, the inventors, have conducted various studies, and closely observed the cooling curves of magnesium alloys. As a result, we have found that the point of inflection on the cooling curve (see the point A in FIG. 1 showing the schematic cooling curve of a magnesium alloy (AZ91 alloy) during solidification) corresponds to the content of aluminum. Thus, we have found that the content of the aluminum component in the magnesium alloy can be estimated by the use of the shape of the cooling curve. These findings have led us to accomplish the present invention. A first method for production of a magnesium alloy related to the present invention based on these findings is characterized by converting a magnesium alloy into a molten state in a magnesium melting furnace, taking a sample out of the molten magnesium alloy, measuring the cooling curve of the sample during solidification, and analyzing the content of the aluminum component in the sample in front of the melting furnace for the magnesium alloy by the use of the crystallization temperature of a phase appearing in the cooling curve, together with cooling curves.

A second method for production of a magnesium alloy is the first method for production, which is characterized in that an inert, nonflammable gas such as argon gas, $SF_6$ or $CO_2$ is flowed on the molten magnesium alloy to prevent combustion and ensure accurate measurement.

A third method for production of a magnesium alloy is the first or second method for production, which is characterized in that a container for pouring the molten magnesium alloy and measuring the cooling curve during solidification is heated to 100° C. or higher beforehand.

A fourth method for production of a magnesium alloy is any of the first to third methods for production, which is characterized in that if the analysis in front of the melting furnace shows the components to deviate from the standard values and target values, an aluminum-manganese master alloy, aluminum or magnesium is added to the molten magnesium alloy to adjust the components to an appropriate amount of aluminum or an appropriate iron/manganese ratio.

That is, the present invention is a method for production of a magnesium alloy, which, when making an analysis in front of the melting furnace, comprises, taking a sample out of the molten magnesium alloy, measuring the cooling curve of the sample during solidification, and determining the content of the aluminum component in the sample by the use of the crystallization temperature of a phase appearing in the cooling curve, and a preliminarily prepared calibration curve (prepared as shown in FIG. 2 based on the crystallization temperatures of samples with known aluminum concentrations).

On the other hand, the present invention is a method for production of a magnesium alloy, which, when adjusting the components, comprises adding an aluminum-manganese master alloy, aluminum or magnesium if the aluminum component measured in the above-mentioned manner deviates from the appropriate value, thereby forming a molten magnesium alloy with a corrected aluminum content.

Particularly during die casting, the amount of iron in the molten metal necessarily increases, so that the addition of the aluminum-manganese master alloy results in the appropriate iron/manganese ratio. Furthermore, alloy characteristics can be adjusted such that a target value for addition of the aluminum component is set at a value suitable for excellent fluidity, in particular.

A first method for production of a high fluidity magnesium alloy related to the present invention is a method for production of a magnesium alloy containing 9.0 to 11.0% by weight of aluminum, 0 to 1% by weight of zinc, 0 to 1% by weight of manganese, and the remainder comprising magnesium and incidental impurities, characterized by measuring the cooling curve of a molten alloy during solidification, determining the content of the aluminum component in the molten metal by the use of the crystallization temperature of a phase appearing in the cooling curve, together with cooling curves, and adding aluminum, magnesium or an aluminum-manganese master alloy to a melting furnace.

A second method for production of a high fluidity magnesium alloy is a method for production of a magnesium alloy containing 6.0 to 8.0% by weight of aluminum, 0 to 1% by weight of manganese, and the remainder comprising magnesium and incidental impurities, characterized by measuring the cooling curve of a molten alloy during solidification, determining the content of the aluminum component in the molten metal by the use of the crystallization temperature of a phase appearing in the cooling curve, together with cooling curves, and adding aluminum, magnesium or an aluminum-manganese master alloy to a melting furnace.

A third method for production of a high fluidity magnesium alloy is the first or second method for production of a high fluidity magnesium alloy, characterized by adding one or more of 0 to 2% by weight of calcium and 0 to 3% by weight of a rare earth element.

On the other hand, the high fluidity magnesium alloy of the present invention is characterized in that it is produced by any of the first to third methods for production of a high fluidity magnesium alloy.

BEST MODE FOR CARRYING OUT THE INVENTION

The best mode for carrying out the present invention will now be described.

Figure 1:
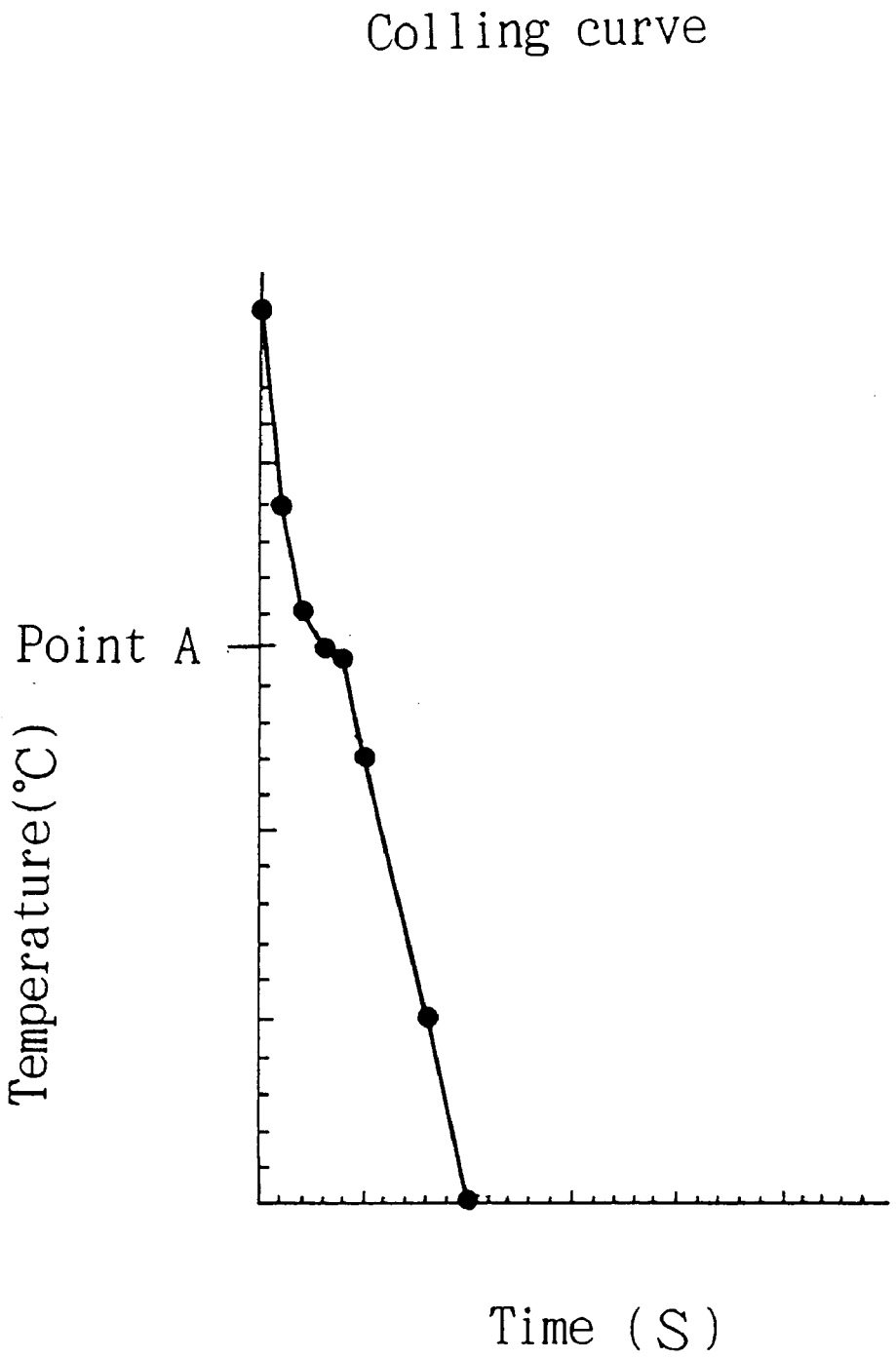
FIG. 1 is a view showing the schematic cooling curve of a magnesium alloy (AZ91 alloy) during solidification.

FIG. 1 shows the schematic cooling curve of a magnesium alloy (AZ91 alloy) during solidification.

In FIG. 1, point A is the crystallization temperature of a primary crystal due to aluminum.

Figure 2:
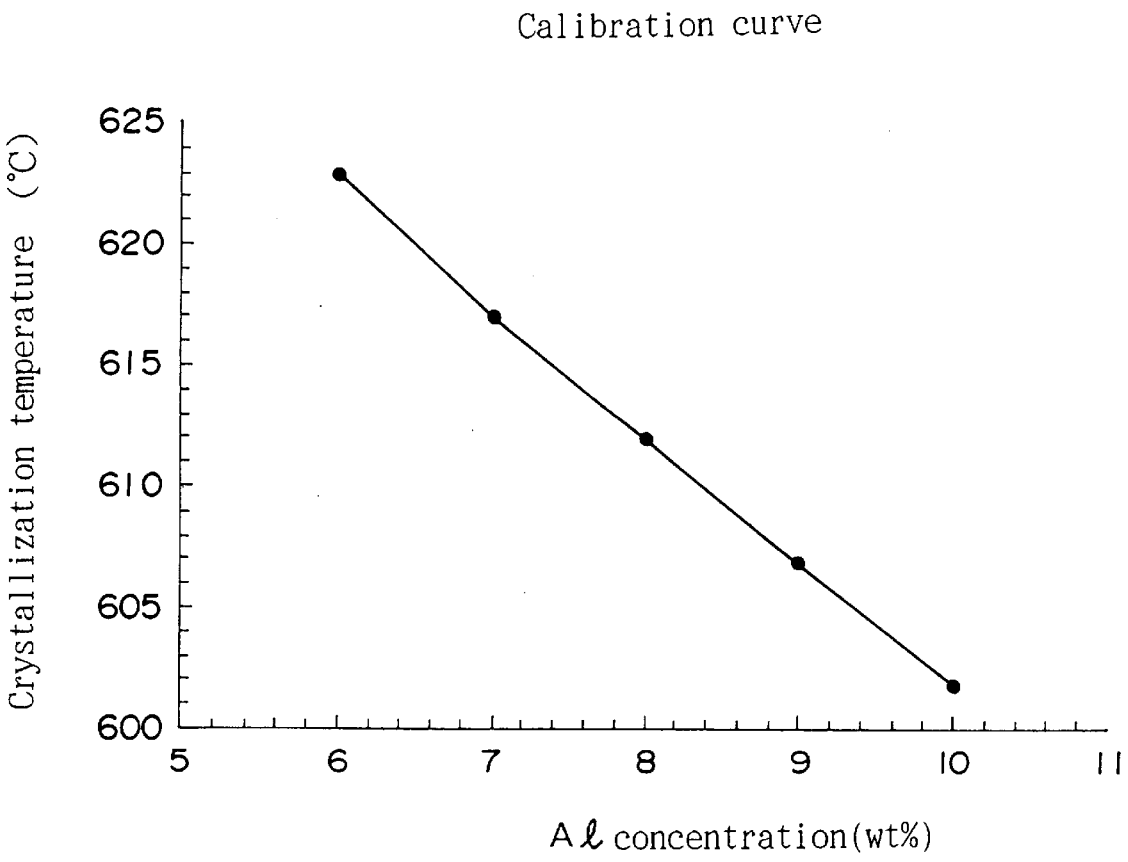
FIG. 2 is a view of a preliminarily prepared calibration curve showing the relation between the aluminum content and the crystallization temperature of a primary crystal of a magnesium-X weight % aluminum alloy.

FIG. 2 gives a preliminarily prepared calibration curve showing the relation between the aluminum content and the crystallization temperature of a primary crystal of a magnesium-X weight % aluminum alloy.

In the present invention, a sample of a molten magnesium alloy is taken out of a melting furnace, and the cooling curve of the sample during solidification is measured using a thermocouple and a recorder.

Separately, a calibration curve is obtained for various magnesium alloys. The crystallization temperature of an aluminum phase that has appeared, and the calibration curve are used to determine the content of the aluminum component in the sample.

A sample is withdrawn from the molten magnesium alloy. The shape of the cooling curve of the sample during solidification is applied to the calibration curve shown in FIG. 2. Thus, the proportion of the aluminum component in the molten magnesium alloy is estimated.

If the so obtained estimated value of the aluminum content deviates from the standard value or target value, an aluminum-manganese alloy and aluminum or magnesium are added, whereby a magnesium alloy with an appropriate aluminum content can be prepared.

During this operation, the molten magnesium alloy may burn. To prevent this phenomenon, an inert, nonflammable gas such as argon gas, $SF_6$ or $CO_2$ is flowed on the molten magnesium alloy during measurement, thereby improving the accuracy of measurement.

Instead of introducing the above inert gas, the entire crucible may be placed in a container having an argon gas atmosphere.

In the above-mentioned measurement, the temperature of the molten magnesium alloy, and the temperature of a container (cup) for pouring the molten magnesium alloy and measuring the cooling curve during solidification greatly affect the accuracy of measurement. With the present invention, therefore, it is preferred tat the container for the molten metal be heated beforehand to 100° C. or higher, preferably 200° C. or higher.

The fine adjustment of the alloy capable of controlling the amount of aluminum highly accurately on the basis of the estimated amount of aluminum is performed in front of the melting furnace on the part of the alloy casting manufacturer for magnesium alloys.

Next follows a description of an invention for producing a high fluidity magnesium alloy with improved fluidity which employs the above controlling method.

According to the present invention, concerned with a method for producing a magnesium alloy of the desired composition, the cooling curve of a molten alloy during solidification is measured, the crystallization temperature of a phase appearing in the cooling curve is used together with cooling curves to determine the content of the aluminum component in the molten metal, and aluminum, magnesium or an aluminum-manganese master alloy is added into the melting furnace.

As a measure for improving the fluidity of a magnesium alloy, a marked change in the composition of a general purpose alloy is available. However, this measure varies the strength characteristics or physical properties of the alloy. This causes the necessity for investigating the use characteristics, including the reliability of the alloy.

Hence, as the composition of a magnesium alloy, it is practical to use a region with a low melting point and high fluidity within the composition of a conventional general purpose alloy or within a range close to the composition of the general purpose alloy.

Our various studies have shown that the fluidity is inversely proportional to the reciprocal of the difference between the molten metal temperature and the melting point of the alloy, so that lowering the melting point of the alloy is effective for improving the fluidity.

With a magnesium(Mg)-aluminum(Al) alloy, for example, the higher the aluminum component content, the lower the melting point. Within the range of the composition of the conventional general purpose alloy, a region with a high aluminum content gives a high fluidity. The addition of Si, Ca or a rare earth element which forms a eutectic system with Mg also lowers the melting point, thus increasing fluidity.

In the case of an AZ91 alloy, for example, the amount of aluminum in the composition ranges from 8.3 to 9.7%. When the aluminum content is set within the range of 9.0% to 9.7%, the upper half region in the composition, especially at 9.7%, the melting point is 595° C. This temperature is 10° C. lower than 605° C., the melting point when the aluminum content is set at, say, 8.7% in the lower half region in the composition.

With this AZ91 alloy, the main properties of the alloy, other than the melting point, are deemed not to vary until the aluminum content reaches 11.0%.

In the case of an AM60 alloy, the amount of aluminum in the composition ranges from 5.5 to 6.5%. When the aluminum content is set within the range of 6.0% to 6.5%, the upper half region in the composition, the melting point is 625° C. This temperature is 10° C. lower than 635° C., the melting point when the aluminum content is set at 5.5% in the lower half region in the composition.

With this AM60 alloy, the main properties of the alloy, other than the melting point, are deemed not to vary until the aluminum content reaches 8.0%.

Further addition of calcium, silicon or a rare earth element forms a eutectic with magnesium, reducing the melting point.

These elements do not exert adverse influences, except a slight increase in heat stability. However, if the amount of calcium or silicon added exceeds 2%, or if the amount of the rare earth element added exceeds 3%, the properties of the AZ91 alloy or the AM60 alloy will vary. This is not desirable.

The effect of lowering the melting point by the addition of each of these elements is a drop of about 10° when the element is used in the predetermined range. The drop becomes greater if the elements are used in combination.

The magnesium alloy with the improved fluidity is concretely produced on an industrial scale by estimating the aluminum content in front of the furnace, and improving it to a predetermined aluminum content, on the part of the casting manufacturer.

That is, a predetermined alloy can be obtained easily and inexpensively by estimating the aluminum content from the shape of the cooling curve of a molten alloy during solidification, and adding aluminum, magnesium or an aluminum-manganese master alloy, where necessary, to the melting furnace.

EXAMPLES

A preferred embodiment of the present invention will be described, but does not restrict this invention.

Example 1

Five types of magnesium alloys with chemical analysis values shown were produced in molten form.

Samples were taken from these molten alloys, and heated to 700° C. Then, each sample was transferred into a cup for measurement of a cooling curve, and its cooling curve was measured using a thermocouple and a recorder.

The molten magnesium alloy burns upon contact with air, forming oxides. To make bath analysis accurately, therefore, an inert, nonflammable gas or the like was introduced to avoid contact of the molten metal with air when the sample was withdrawn from the melting furnace. That is, the inert, nonflammable gas or the like was introduced to cover an upper part of the molten metal. During this period, the surroundings were shielded. Only the upper part was transferred into a measuring cup in an opening/closing jig for cooling curve measurement. Immediately thereafter, a closure equipped with a nonflammable gas introduction tube was applied, and the cooling curve was measured with the nonflammable gas being flowed.

From the thus obtained cooling curves, a calibration curve as shown in FIG. 2 was prepared.

Separately, 5 types of molten alloys with unknown aluminum contents were measured for cooling curves by the same procedure as described above. The points A's in FIG. 1 were found, and the estimated values of the aluminum contents were obtained from the calibration curve shown in FIG. 2. These values are shown in Table 1 in comparison with the amounts of aluminum chemically analyzed.

The above measurements were all performed with the container for the molten metal being preheated at 200° C.

TABLE 1

| Test Example. No. | Bath analysis value (% by weight) | Chemical analysis value (% by weight) |
|---|---|---|
| 1 | 6.3 | 6.33 |
| 2 | 6.9 | 6.90 |
| 3 | 8.0 | 8.10 |
| 4 | 8.9 | 9.02 |
| 5 | 9.9 | 9.93 |

As the above data in Table 1 show, the bath analysis method of the present invention enabled the aluminum content to be estimated with an accuracy within the range of ±0.1% by weight.

Example 2

With respect to the aluminum concentrations measured by the method of Example 1, an aluminum-manganese master alloy, aluminum and magnesium were each added with the aluminum content targeted at 9.0%, and the chemical components were confirmed.

The results are shown in Table 2.

The reason for using the aluminum-manganese master alloy is that since the iron concentration increases during die casting, manganese is added to decrease the iron concentration.

The results obtained by the addition of the aluminum-manganese master alloy are given in Table 3.

TABLE 2

| Test Example No. | Before addition Bath analysis value (wt. %) Al | Metal added | After addition Chemical analysis value (wt. %) Al | Deviation from target value (wt. %) |
|---|---|---|---|---|
| 1 | 8.2 | Aluminum-manganese master alloy | 9.03 | +0.03 |
| 2 | 8.2 | Aluminum-manganese master alloy | 9.05 | +0.05 |
| 3 | 8.5 | Aluminum | 8.98 | −0.02 |
| 4 | 8.4 | Aluminum | 9.02 | +0.02 |
| 5 | 9.2 | Nagnesium | 9.05 | +0.05 |
| 6 | 9.1 | Magnesium | 8.97 | −0.03 |

TABLE 3

When aluminum-manganese master alloy was added

| Test Example No. | Chemical analysis value (wt. %) Before addition Mn | Before addition Fe | After addition Mn | After addition Fe |
|---|---|---|---|---|
| 1 | 0.20 | 141 | 0.30 | 35 |
| 2 | 0.24 | 87 | 0.28 | 18 |

Fe content was expressed in ppm.

As the data in Table 2 show, the accuracies of the chemical analysis values relative to the target composition were within the range of ±0.1% by weight.

When the aluminum-manganese master alloy was used to add aluminum, the increasing amount of iron was confirmed to be suppressed by the addition of manganese, as shown in Table 3. After addition of the aluminum-manganese master alloy, as the manganese concentration increased, the iron concentration decreased, obtaining an appropriate iron/manganese ratio.

Example 3

This is an example of the production of a high fluidity magnesium alloy of a predetermined composition by the use of the bath analysis method of the present invention.

Figure 3:
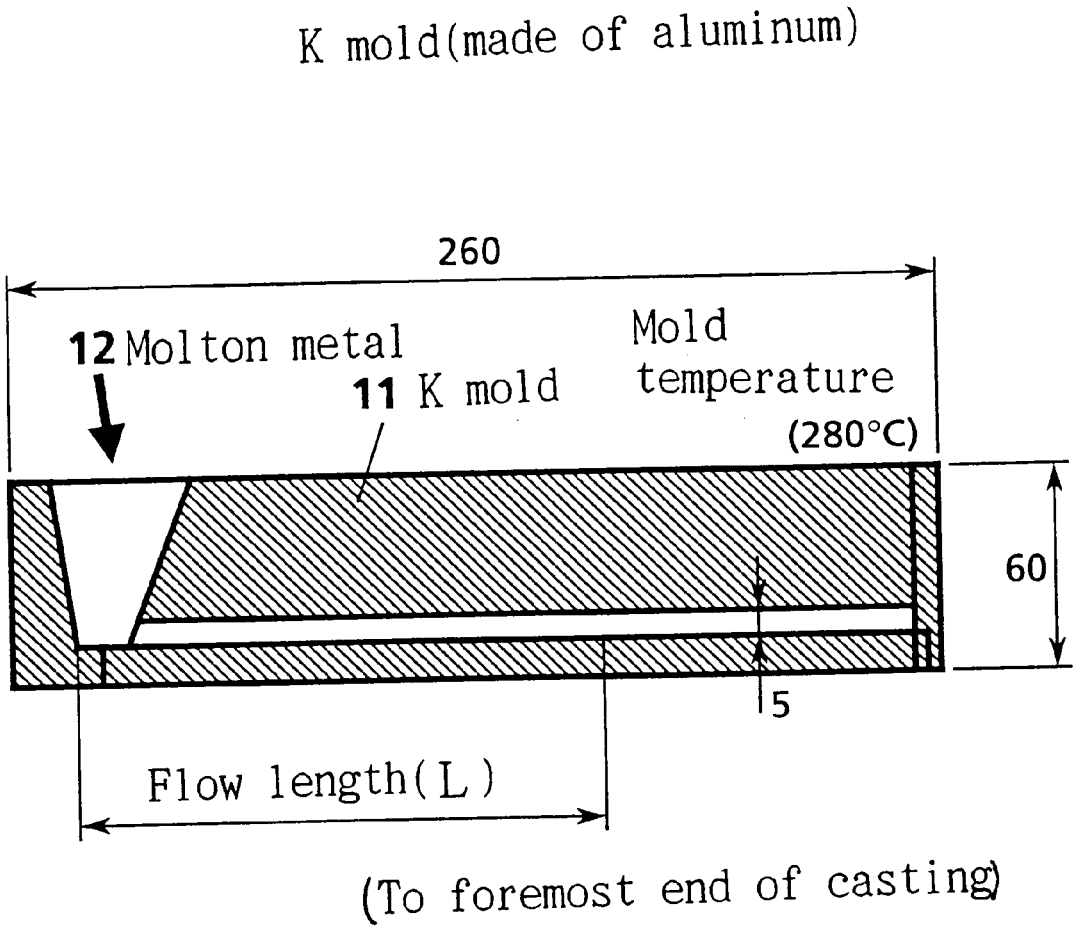
FIG. 3 is a schematic view of a mold for testing the fluidity of a magnesium alloy.

FIG. 3 is a schematic view of a mold for testing the fluidity of a magnesium alloy. In FIG. 3, the reference numeral 11 designates a K mold, and 12 molten metal. The dimensions of the K mold were as follows: Length: 260 mm, height: 60 mm, and diameter of hole for measuring flow length: 5 mm.

In the same manner as described above, five types of magnesium alloys with chemical analysis values shown were produced in molten form. Samples were taken from these molten alloys, and heated to 700° C. Then, each sample was transferred into a cup for measurement of a cooling curve, and its cooling curve was measured using a thermocouple and a recorder. From the thus obtained cooling curves, a calibration curve as shown in FIG. 2 was prepared.

Comparative Examples 1 and 2

Commercially available AZ91 alloy (Comparative Example 1) and AM60 alloy (Comparative Example 2) were each melted in a graphite crucible. The amounts of aluminum in the molten metals were estimated at 8.3% and 5.6%, respectively, based on the shapes of the cooling curves of the molten metals during solidification.

The composition of the alloy of Comparative Example 1 was aluminum (Al: 8.22%)-zinc (Zn: 0.55%)-manganese (Mn: 0.25%), while the composition of the alloy of Comparative Example 2 was aluminum (Al: 5.53%)-manganese (Mn: 0.20%).

Test Examples 1 to 10

Test Examples 1 to 6 were performed by adding aluminum, etc. to the AZ91 alloy of Comparative Example 1 so that the estimated values (target values) of aluminum shown in Table 4 would be obtained. For this purpose, aluminum, calcium, silicon and mish metal (50% Ce, 45% La, and other rare earth elements) were suitably added to adjust the aluminum content to the upper limit of the standard value.

Test Examples 7 to 10 were performed by adding aluminum, etc. to the AM60 alloy of Comparative Example 2 so that the target values of aluminum shown in Table 4 would be obtained. For this purpose, aluminum, calcium, silicon and mish metal (50% Ce, 45% La, and other rare earth elements) were suitably added.

Table 4 shows the analysis values after addition of aluminum by the target values. As shown in this table, the anlysis values were all close to the target values.

The fluidity was evaluated by pouring a molten metal 12 into a K mold 11 as shown in FIG. 3 at a molten metal temperature of 620° C. for the AZ91 alloy or 660° C. for the AM alloy, and measuring a flow length L.

The flow lengths (mm) measured are also given in Table 4.

TABLE 4

| | Aluminum estimated value/target value | Aluminum analysis value | Other element | Flow length (mm) |
|---|---|---|---|---|
| Comp. Ex. 1 | 8.3 | 8.22 | | 75 |
| Test Ex. 1 | 9.0 | 9.11 | | 105 |
| Test Ex. 2 | 9.7 | 9.66 | | 135 |
| Test Ex. 3 | 11.0 | 10.88 | | 175 |
| Test Ex. 4 | 9.7 | 9.67 | Ca 1.0 | 155 |
| Test Ex. 5 | 9.7 | 9.64 | Si 0.5 | 160 |
| Test Ex. 6 | 9.7 | 9.64 | Mm 1.0 | 150 |
| Comp. Ex. 2 | 5.6 | 5.53 | | 95 |
| Test Ex. 7 | 6.5 | 6.47 | | 140 |
| Test Ex. 8 | 8.0 | 7.91 | | 180 |
| Test Ex. 9 | 6.5 | 6.53 | Ca 0.5 Si 1.0 | 165 |
| Test Ex. 10 | 6.5 | 6.40 | Si 1.0 Mm 2.0 | 150 |

When commercially available alloys (Comparative Examples) were each melted, on the other hand, aluminum-manganese sludge was formed, and the amount of aluminum decreased. As a result, the aluminum analysis values of the molten metals were low, and close to the lower limit of the standard value.

When the aluminum contents were adjusted to the upper limit of the standard value, the melting points dropped by 10° C. or more, confirming that the flow lengths in the K mold shown in FIG. 3 were markedly improved.

INDUSTRIAL APPLICABILITY

According to the present invention, when a magnesium alloy is produced, bath analysis made in front of the melting furnace makes it possible to estimate changes in the aluminum content in molten magnesium alloy by utilizing the shape of the cooling curve of the molten magnesium alloy during solidification. By this measure, the degree of consumption of aluminum in the molten magnesium alloy can be known easily and rapidly at the site of casting. Thus, prompt adjustment of the alloy components can be made, whereby a high fluidity magnesium alloy can be produced.

According to the present invention, moreover, a high fluidity alloy can achieve improved fluidity in a range in which the great properties of a general purpose alloy are not varied.

As a method for producing such an alloy, estimation of the aluminum content by utilizing the shape of the cooling curve of molten metal during solidification, and the addition of aluminum, etc. to the molten metal are combined, whereby the alloy composition can be finely adjusted easily and inexpensively.

Hence, a magnesium alloy suitable for thin-walled or precision magnesium parts can be produced in a simple manner.

We claim:

1. A method for production of a magnesium alloy, characterized by:

converting a magnesium alloy containing aluminum into a molten state magnesium alloy in a magnesium melting furnace;

taking a sample out of the molten magnesium alloy;

measuring the cooling curve of the sample during solidification;

analyzing the content of the aluminum component in the sample in front of the melting furnace for the magnesium alloy by the use of the crystallization temperature of a phase appearing in the cooling curve, together with cooling curves;

adding an amount of magnesium or aluminum as necessary to the molten magnesium alloy.

2. The method for production of a magnesium alloy as claimed in claim 1, characterized in that an inert, nonflammable gas is flowed on the molten magnesium alloy.

3. The method for production of a magnesium alloy as claimed in claim 1, characterized in that a container for pouring the molten magnesium alloy and measuring the cooling curve during solidification is heated to 100° C. or higher beforehand.

4. The method for production of a magnesium alloy as claimed in claim 1 or 2 further containing iron and manganese, characterized in that if the analysis in front of the melting furnace shows the components to deviate from the standard values and target values, an aluminum-manganese master alloy, aluminum or magnesium is added to the molten magnesium alloy to adjust the components to an appropriate amount of aluminum or an appropriate iron/manganese ratio.

5. A method for production of a high fluidity magnesium alloy containing 9.0 to 11.0% by weight of aluminum, 0 to 1% by weight of zinc, 0 to 1% by weight of manganese, and the remainder comprising magnesium and incidental impurities, characterized by:

measuring the cooling curve of a molten state of said alloy during solidification;

determining the content of the aluminum component in the molten alloy by the use of the crystallization temperature of a phase appearing in the cooling curve, together with cooling curves; and adding aluminum, magnesium or an aluminum-manganese master alloy to the molten alloy to produce a high fluidity magnesium alloy.

6. A method for production of a high fluidity magnesium alloy containing 6.0 to 8.0% by weight of aluminum, 0 to 1% by weight of manganese, and the remainder comprising magnesium and incidental impurities, characterized by:

measuring the cooling curve of a molten state of said alloy during solidification;

determining the content of the aluminum component in the molten alloy by the use of the crystallization temperature of a phase appearing in the cooling curve, together with cooling curves; and adding aluminum, magnesium or an aluminum-manganese master alloy to the molten alloy to produce a high fluidity magnesium alloy.

7. The method for production of a high fluidity magnesium alloy as claimed in claim 5, characterized by adding one or more of 0 to 2% by weight of calcium and 0 to 3% by weight of a rare earth element to said alloy.

8. High fluidity magnesium alloy characterized by being produced by the method for production of a high fluidity magnesium alloy as claimed in claim 5.

9. A high fluidity magnesium alloy characterized by being produced by the method for production of a high fluidity magnesium alloy as claimed in claim 6.

10. A high fluidity magnesium alloy characterized by being produced by the method for production of a high fluidity magnesium alloy as claimed in claim 7.

* * * * *

UNITED STATES PATENT AND TRADEMARK OFFICE

CERTIFICATE OF CORRECTION

PATENT NO. : 6,056,834
DATED : May 2, 2000
INVENTOR(S) : K.Kubota et al.

It is certified that error appears in the above-identified patent and that said Letters Patent is hereby corrected as shown below:

Title page,
[22] change "PCT Filed: Nov. 15, 1997" to -- PCT Filed: Nov. 25, 1997 --
[30] Under "Foreign Application Priority Data", change serial number "9/003457" to -- 9/003547 --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*